US008512178B2

(12) United States Patent
Peetz et al.

(10) Patent No.: US 8,512,178 B2
(45) Date of Patent: Aug. 20, 2013

(54) SLINGBLADE BROAD-HEAD DELIVERY SYSTEM

(76) Inventors: Jason L Peetz, Tomahawk, WI (US); Mark F Schroeder, Gleason, WI (US)

( * ) Notice: Subject to any disclaimer, the term of this patent is extended or adjusted under 35 U.S.C. 154(b) by 8 days.

(21) Appl. No.: 13/167,619

(22) Filed: Jun. 23, 2011

(65) Prior Publication Data

US 2012/0329586 A1 Dec. 27, 2012

(51) Int. Cl.
*F42B 6/08* (2006.01)

(52) U.S. Cl.
USPC ..... 473/583

(58) Field of Classification Search
USPC ..... 473/578, 582, 583
See application file for complete search history.

(56) References Cited

U.S. PATENT DOCUMENTS

| | | | | |
|---|---|---|---|---|
| 2,805,067 | A | 9/1957 | Ryan | |
| 3,417,994 | A | 12/1968 | Rohrbaugh, Jr. | |
| 3,572,716 | A * | 3/1971 | Bear | 473/581 |
| 3,790,948 | A | 2/1974 | Ratkovich | |
| 3,893,866 | A * | 7/1975 | Hollingsworth | 473/581 |
| 4,704,612 | A | 11/1987 | Boy et al. | |
| 4,749,198 | A | 6/1988 | Brailean | |
| 4,801,151 | A | 1/1989 | Sturm et al. | |
| 4,836,557 | A | 6/1989 | Polando | |
| 4,846,481 | A | 7/1989 | Wageman | |
| 4,858,935 | A | 8/1989 | Capson | |
| 4,885,800 | A | 12/1989 | Ragle | |
| 4,951,952 | A | 8/1990 | Saddler | |
| RE33,470 | E | 12/1990 | Boy et al. | |
| 4,976,442 | A | 12/1990 | Treadway | |
| 4,976,443 | A | 12/1990 | De Lucia | |
| 5,094,463 | A | 3/1992 | Dryden | |
| 5,157,405 | A | 10/1992 | Wycoff et al. | |
| 5,294,131 | A | 3/1994 | Manske | |
| 5,446,467 | A | 8/1995 | Willett | |
| 5,450,614 | A | 9/1995 | Rodriguez | |
| 5,496,041 | A | 3/1996 | Broussard | |
| 6,311,623 | B1 | 11/2001 | Zaruba | |
| 6,409,617 | B1 | 6/2002 | Armold | |
| D489,116 | S | 4/2004 | Watson, Jr. et al. | |
| 6,764,420 | B2 | 7/2004 | Cyr et al. | |
| 6,814,678 | B2 | 11/2004 | Cyr et al. | |
| 6,856,250 | B2 | 2/2005 | Hilliard | |
| 7,232,389 | B2 | 6/2007 | Monteleone | |
| 7,300,367 | B1 | 11/2007 | Andol et al. | |
| 2005/0130774 | A1 | 6/2005 | Wohlfeil et al. | |
| 2005/0231362 | A1 | 10/2005 | Pridmore, Jr. et al. | |
| 2007/0105668 | A1 | 5/2007 | Kikos | |
| 2007/0142137 | A1 | 6/2007 | Davenhaver | |
| 2008/0207357 | A1 | 8/2008 | Savarese et al. | |
| 2010/0035709 | A1 | 2/2010 | Russell et al. | |
| 2010/0248871 | A1 | 9/2010 | Nick et al. | |

* cited by examiner

*Primary Examiner* — John Ricci
(74) *Attorney, Agent, or Firm* — Lane Patents LLC

(57) ABSTRACT

A bow hunting broad-head system having a mechanical cutter which opens after impact. The broad-head flies to its destination with minimal drag and having good balance. After impact, the tip opens to a larger diameter creating a devastating wound and releases the payload inside the animal.

19 Claims, 10 Drawing Sheets

SLINGBLADE BROAD-HEAD DELIVERY SYSTEM

FIELD OF THE INVENTION

The present invention relates to a device for delivery by a bow or cross bow while hunting and, in particular, to a device which is deployed subcutaneously and deposited into the flesh or cavity of an animal.

BACKGROUND OF THE INVENTION

Bow hunting and cross-bow hunting continue to provide a form of challenge and relaxation enjoyed by many. Hunters constantly seek to harvest animals in a humane way that minimizes suffering, while providing quick recovery to minimize spoilage.

U.S. Pat. No. 4,836,557 issued Jun. 6, 1989 to Polando discloses a game tracking arrow having a segmented shaft wherein a collar is provided approximately midpoint in the shaft. The collar has a larger diameter than at least the housing in the fore part of the shaft. Therefore, as the arrow shaft continues to penetrate the animal, the collar stops the progress of the aft portion, substantially breaking the arrow into two pieces. The aft portion, which is connected to a section of string stored in the fore section, falls to the ground and the string unravels causing a trail of string to be formed. While not having the electronic portion of the at least some embodiments of the present invention, there are several other deficiencies associated with this type of device. The arrow as released from the bow needs to fly straight and true to the target. When shooting, the fore portion of the arrow almost right next to the tip sits upon a rest and is used for aiming. Any protrusion, anomaly, catch, bump, or the like can through the arrow off aim as it passes the edge upon release. Therefore, it is desirable that the arrow be straight, true, and balanced from the tip on back. Further, the Polando design requires the arrow to be divided into sections, which again, creates concern that the arrow shaft is not perfectly straight upon assembly.

U.S. Pat. No. 6,409,617 issued Jun. 25, 2002 to Armold discloses a game tracking arrow wherein a transmitter is ejected from the broad-head when the tip impacts upon the target. While having a transmitter device in the broad-head, thus overcoming the disadvantages of Polando, has other disadvantages. As the mechanism for release is fore from the transmitter, it is feared that the transmitter may eject prematurely causing the transmitter to be ejected outside the animal. And if there is one thing a hunter hates, it's a premature ejection. Further, should the arrow miss the target, the transmitter becomes separated from the arrow shaft leaving the hunter with two things to look for.

U.S. Pat. No. 6,856,250 issued Feb. 15, 2005 to Hilliard shows a transmitter device which hangs on one blade of the broad-head and has a barb for lodging itself to the outside skin of the animal. This approach has several disadvantages, firstly having anything hanging off one blade can cause a significant deflection in the path of the arrow. Also, the foregoing is designed to hang on the hide outside of the animal and can be knocked off as the animal travels through brush and the like. The applicant has seen deer reach back and dislodge and remove an arrow with its teeth. It is not hard to imagine the animal being able to remove a barbed device.

U.S. Pat. App. No. 2007/0105668 published May 10, 2007 to Kikos discloses a barbed attachment mechanism near the arrow fletching. While it may not have the same issue as Polando for breaking the arrow in two, it still has the issue of disruption of the flight path as it crosses the rest, and is designed to hang on the hide outside the animal similar to Hilliard having similar drawbacks.

While these devices and others are designed to fill their respective objectives, there remains an unmet need for a delivery apparatus to deliver a payload, whither subcutaneously to assure it stays with the animal. A payload can comprise any combination of a; blank insert for broad-head load, tracking device, transmitter, explosive, incendiary, neurotoxin, $CO_2$ cartridge, global positioning satellite (gps) device, radio device, stun capacitor, noise maker, seltzer, blood thinner, string attachment, florescent dye, and the like. It is preferred that the device comprise at least a transmitter.

SUMMARY OF THE INVENTION

In accordance with the present invention, there is provided a bow hunting broad-head system having a mechanical cutter which opens after impact. As fired, the broad-head is conceived to fly to its destination with minimal drag, with balance and with no encumbrances or protuberances to interfere with the release of the arrow, the rest, or the flight path. After impact, the tip opens to a larger diameter creating devastating wound channels inside the animal. The present invention makes a smaller entry wound so as to waste less energy on the hide and bone. Then once the broad-head reaches the desired depth within the animal, the head opens into the vital organs, which are much less dense and use less of the arrows kinetic energy allowing for a much greater cutting diameter.

A payload device is integrated within the perimeter of the broad-head in such a way that the broad-head protects the payload, and the device can be utilized to reinforce, minimize deflection, and add strength to the blades during impact. One way to accomplish the desired result is to provide a keyway, which can be seen as a; groove, channel, guide, crease, furrow, undulation, fold, rut or the like which serves to coordinate the motion of the blades to act in unison until released, then to act as a track for the respective blades to slide along to further force the blades to separate into an open position. A spring can be used to open at predetermined pressure to aid in opening the device.

As the blades reach the predetermined depth for opening, the keyway disengages leaving the payload free to deposit to one side or the other within cavity or flesh of the animal.

A trigger or release mechanism disposed aft of the broad-head serves to open the blades at a predetermined depth, thus creating the larger diameter cut while releasing the payload. In a preferred embodiment, the position of the release mechanism is positioned in such a way as to decouple from the depth of release from the diameter of the open blades.

It is therefore an object of the invention to provide a broad-head delivery system having conservation of kinetic energy on impacting the animal which allows for a greater cutting diameter than open outside mechanical broad-heads or fixed blade broad-heads.

It is therefore an object of the invention to of kinetic energy on impacting the animal which allows for greater penetration than devices of the prior art.

It is another object of the invention having a subcutaneous expansion allowing more kinetic energy to be delivered to the animal's internal organs than devices of the prior art.

It is another advantage of the invention to provide more ethical and quicker kills than devices of the prior art.

It is another advantage of the invention to provide a larger exit hole than devices of the prior art.

It is another advantage of the invention to provide a superior blood trail for tracking an animal.

It is another advantage that a superior blood trail can lead to increased game recovery percentage.

It is another advantage that the invention can be adapted to different species of game, different environments, and different hunting situations.

It is another advantage that the invention has increased marketability as internal cutting diameter and penetration depth sells broadheads.

It is another advantage that the invention results in less loss of kinetic energy and deflections when a quartering shot is taken.

It is another advantage to provide a smaller flight profile resulting in less drag and superior accuracy over devices of the prior art.

It is another advantage to provide a broadhead being easier to tune the flight path to the bow than broadheads of the prior art.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION

Figure 1:
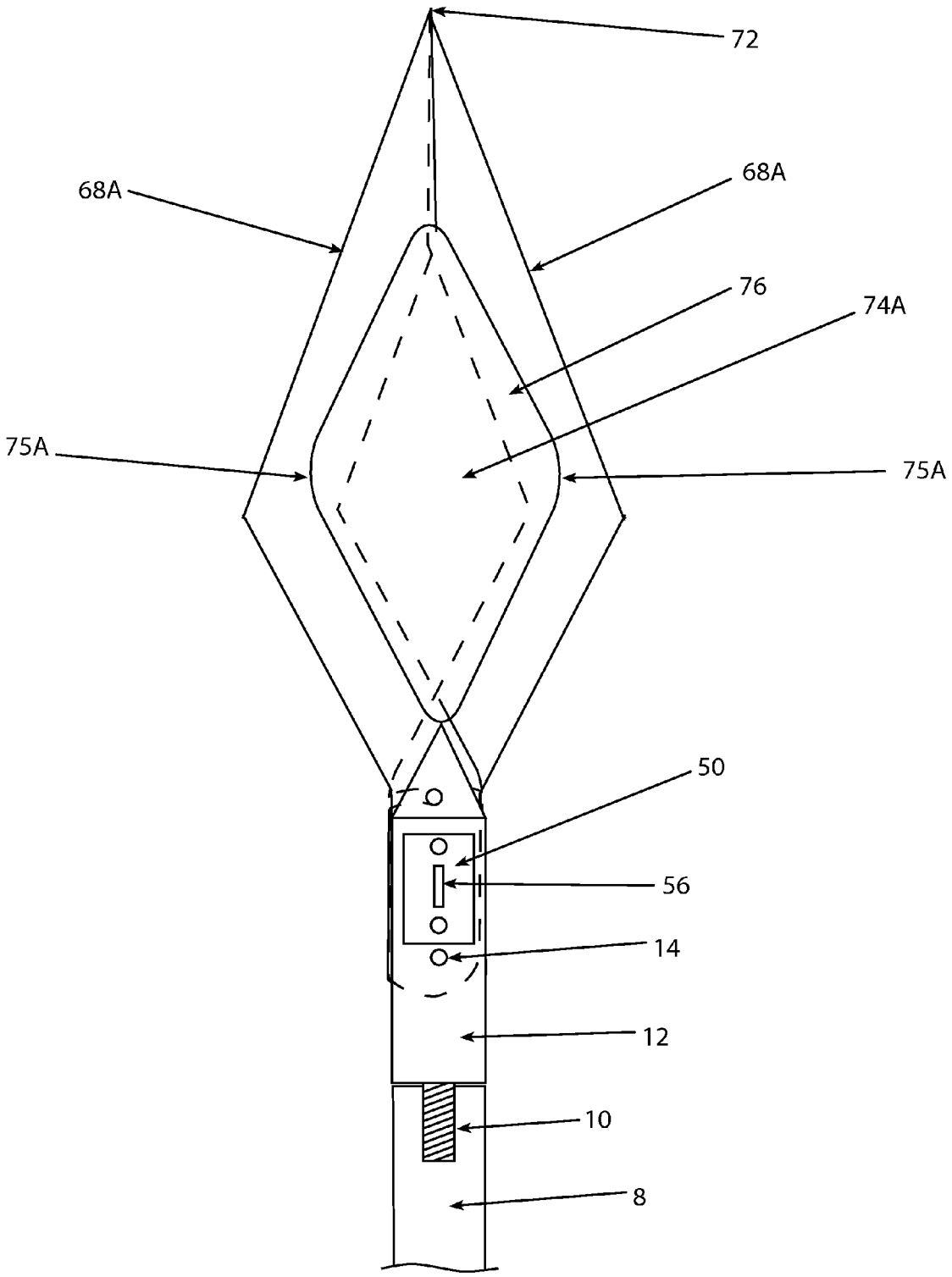
FIG. 1 contains a side view of an embodiment of the present invention.
Figure 2:
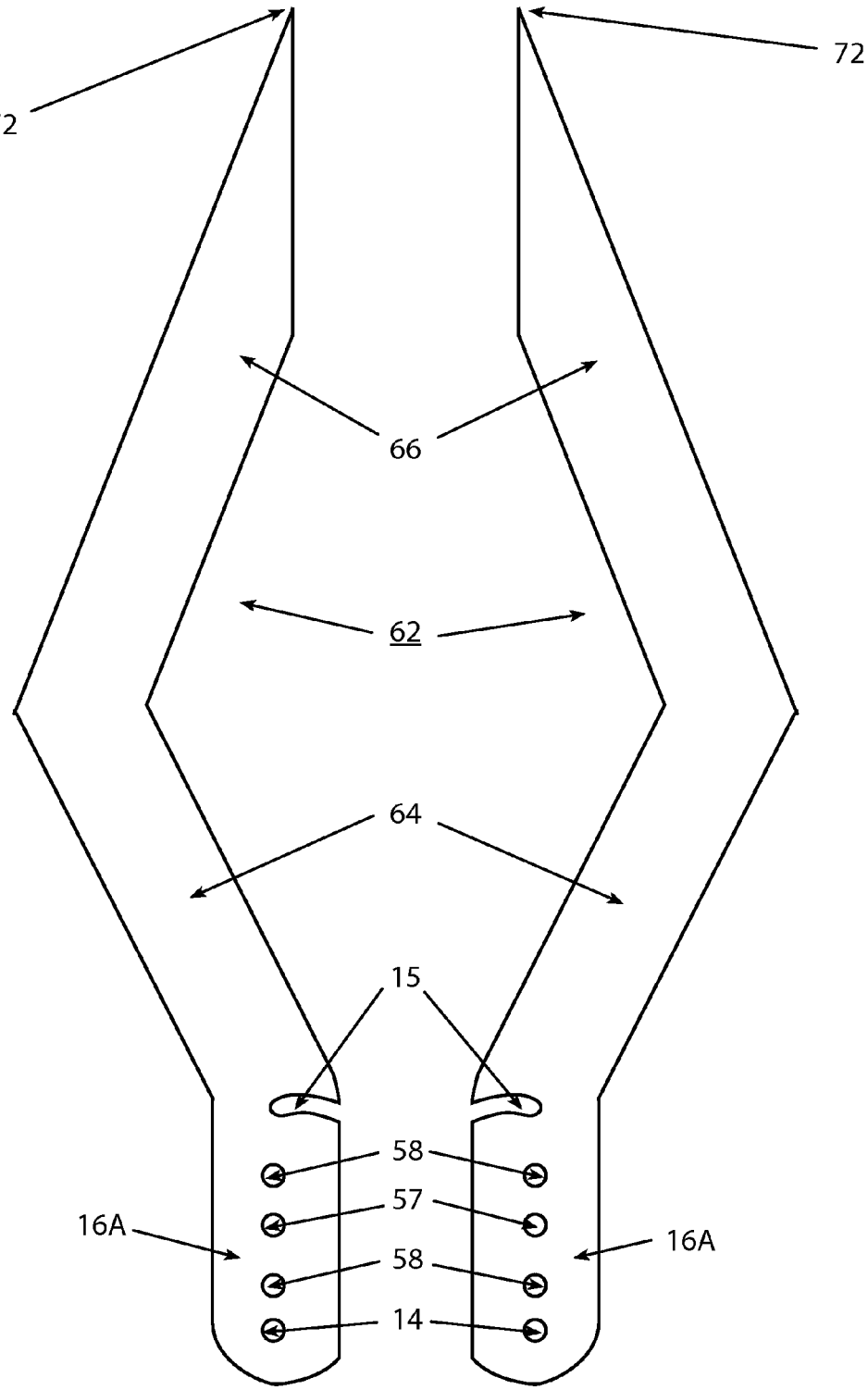
FIG. 2 contains a side view of a pair of blades of an embodiment of the present invention.
Figure 3:
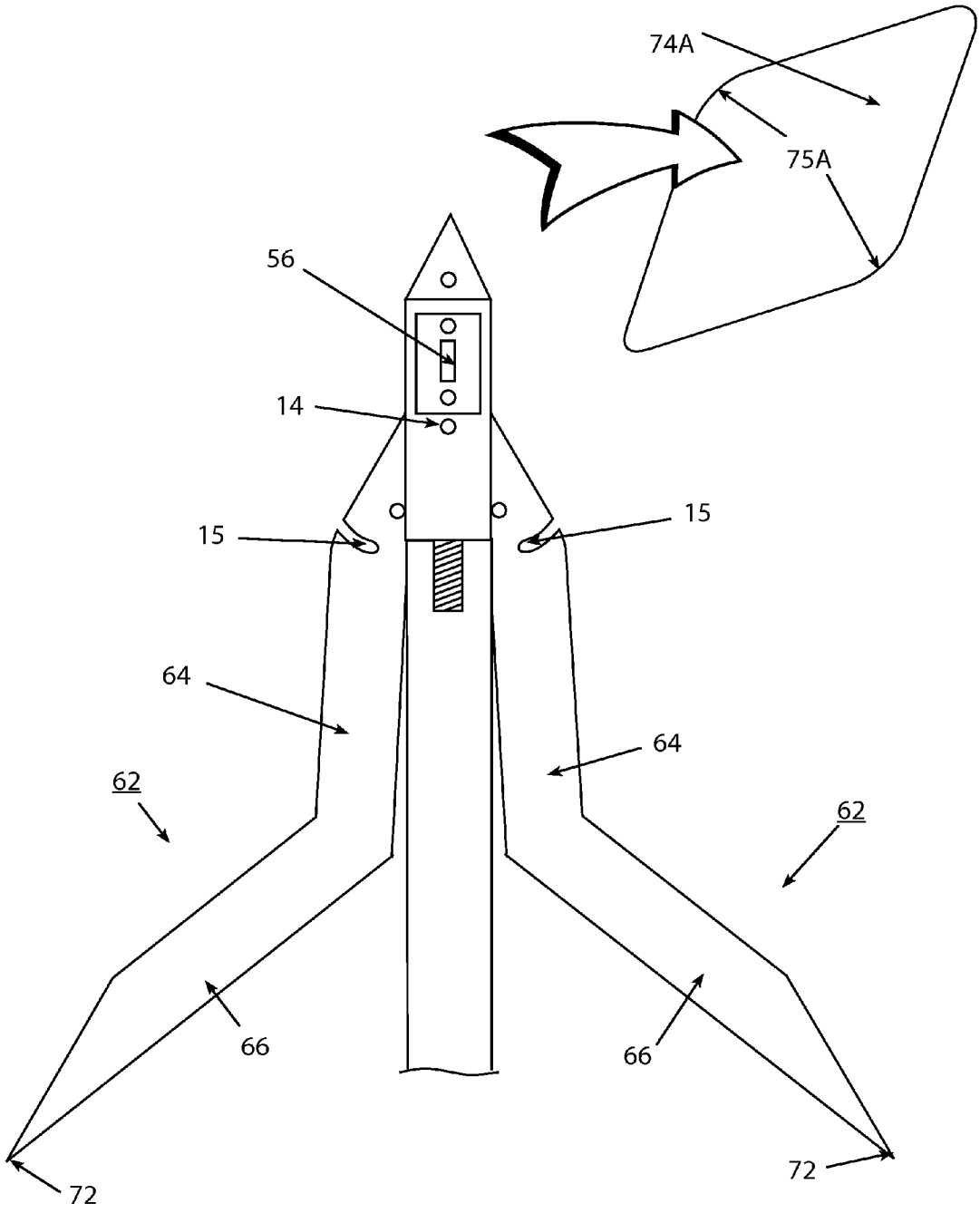
FIG. 3 contains a side view of the embodiment of FIG. 1 in an open position.
Figure 4:
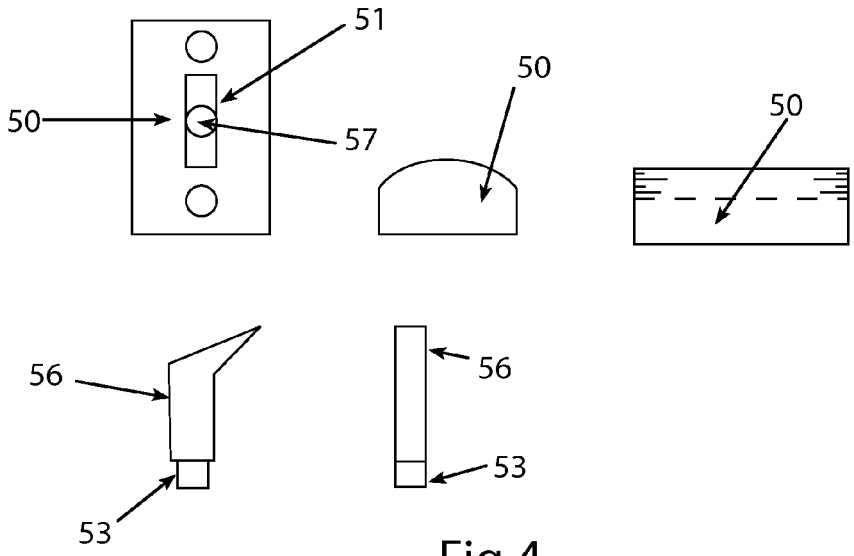
FIG. 4 contains a top, front, and side view of an embodiment of a release mechanism with a side and a front view of a trigger.
Figure 5:
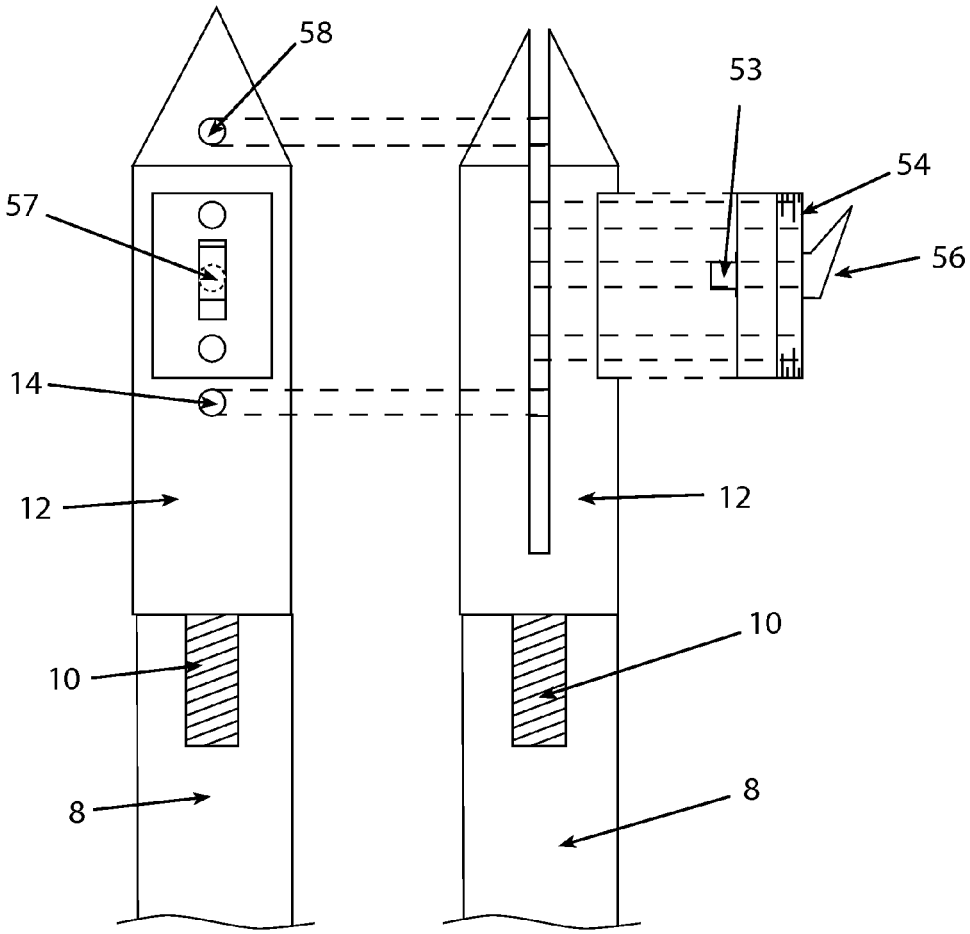
FIG. 5 contains a top view and a side view of an embodiment of a base member combined with a release mechanism and trigger.

In the present invention, FIG. 1 through 6 shows an embodiment of an apparatus suited to release a payload (74A) at a predetermined point. A shaft member (8) is firmly connected with the apparatus by means of a threaded interface (10). The threaded interface (10) was designated to denote a preferred embodiment, however, many suitable replacements such as pins, rods, pop fasteners can be used. The shaft (8) is basically denoted as an arrow shaft containing nocks, fletching, and the like, known to those skilled in the art. Pivots (14) such as pins can be used to provide a swivel or fulcrum point. Ahead of the threaded interface (10), as the arrow flies, is a base member (12) suited for receiving a release housing (50). The release housing (50) further comprising a trigger (56) having a pin (53). The pin (53) being inserted through an opening (51) and the pin (53) being aligned with at least one pin hole (58) from an elongated member (58) and inserted when the blades (62) are brought together in a closed position as shown in FIG. 1. In the closed position, the blades (62) are adapted to at least partially and preferably fully enclose a payload (74), and hold it securely in place.

Figure 6A:
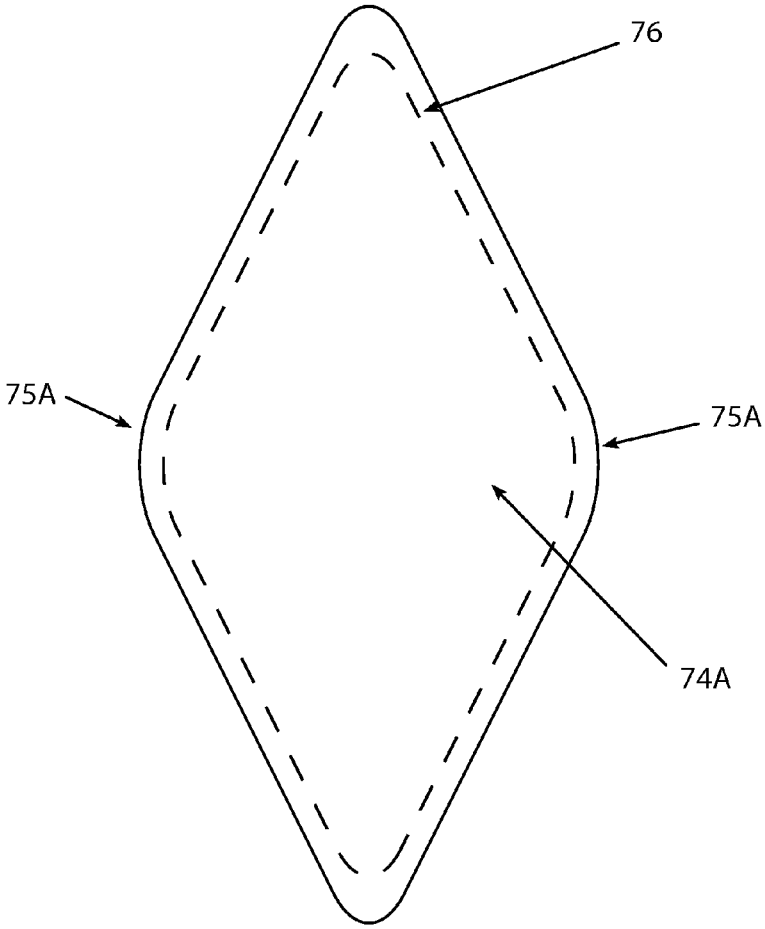
FIG. 6A contains an side view of an embodiment of a payload.
Figure 6B:
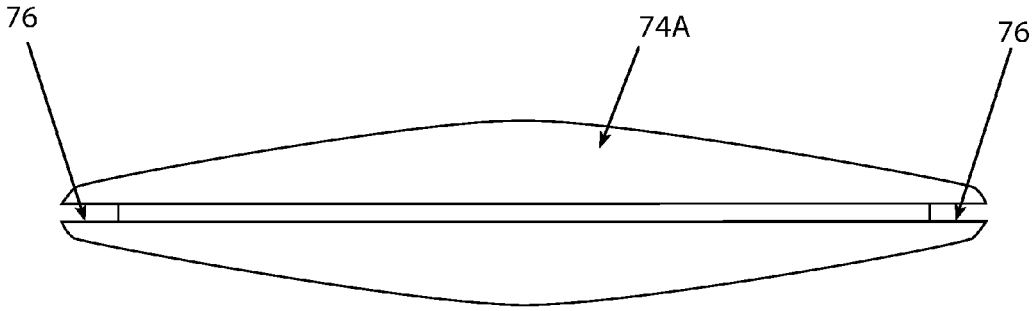
FIG. 6B contains a face view of the embodiment of 6B.

One embodiment of a payload device (74A) is shown in FIGS. 6A, B comprises a groove (76) for interfacing with the mechanical blades (24) (not shown) and preferably having a wide hip (75A) or inflection point for stabilizing the payload device (74A) in flight.

In one embodiment, a trigger mechanism comprising a release housing (50) is inserted into the base member (12) and secured with at least one support pin (54). A trigger (56) comprising a catch and a stop (53) is inserted into at least one latch hole (57) to hold the mechanical blades (24) in place. Upon impact, after the broad-head has pierced the hide of the animal, the trigger (56) catches on the hide and is pulled free, removing the stop (53) from the latch hole (57) allowing the blades (62) to rotate on the pivot (14) and mechanically open.

Figure 7A:
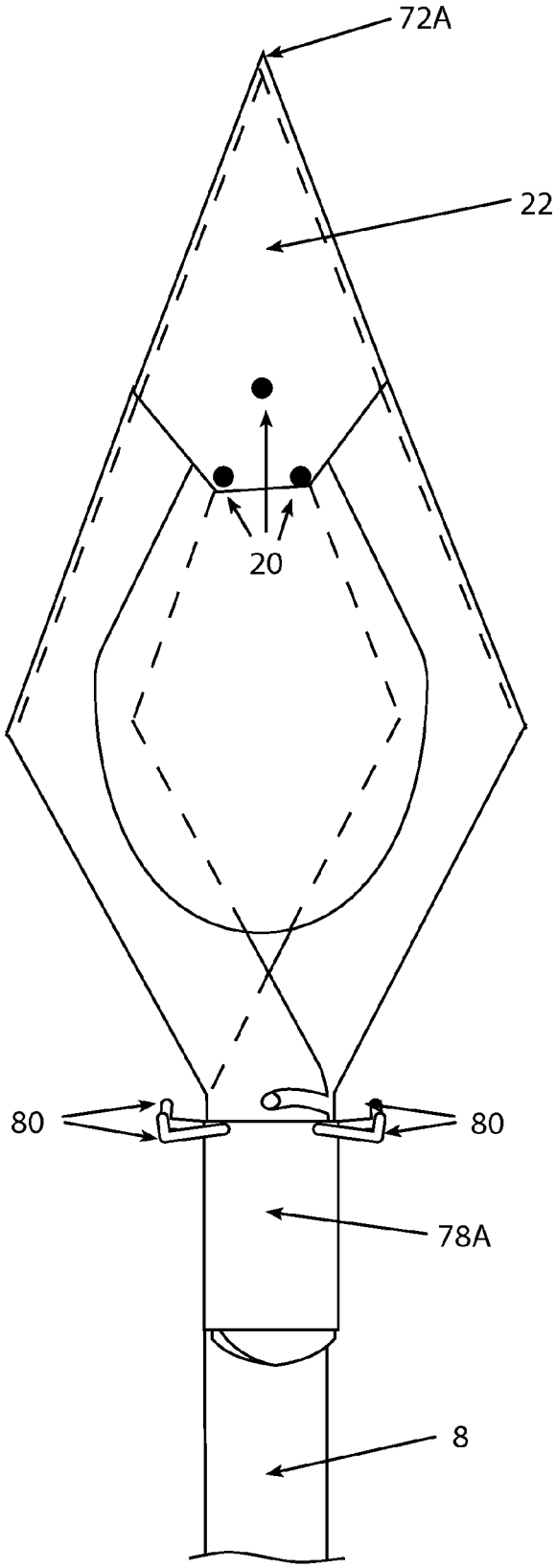
FIG. 7A contains a face view of an alternate embodiment of the present invention.
Figure 7B:
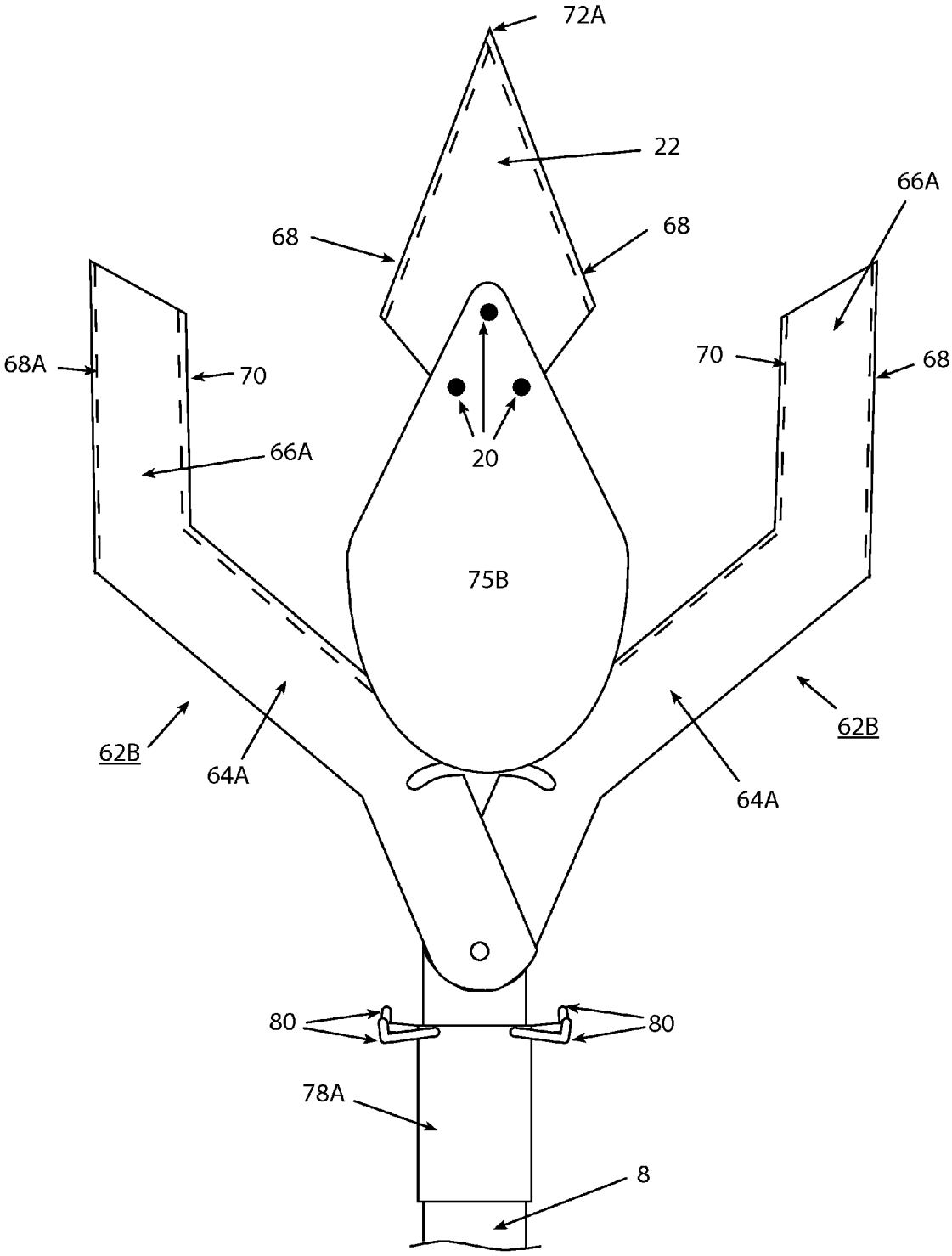
FIG. 7B contains a face view of the embodiment of 7A in a partially open position.

In the alternate embodiment of FIGS. 7A and 7B, the payload (74B) is partly disposed within the blades (62B). In this embodiment, a piercing member (22) is attached to the payload (74B) by means of multiple attachment members (20). The lead cutting edges (68) culminate in a point (72A). Support shanks (64A) are disposed behind the payload (74B) as it flies through the air, with piercing shanks (66A) projecting obliquely from the support shanks (64A) and are designed to be substantially in front of a hip (75B) for holding them in place with cutting edges (68A) for piercing a hide. Cutting edges (70) are also disposed on interior surfaces of the blades (62A) (62B) for continuing to cut once the blades are open.

Figure 8A:
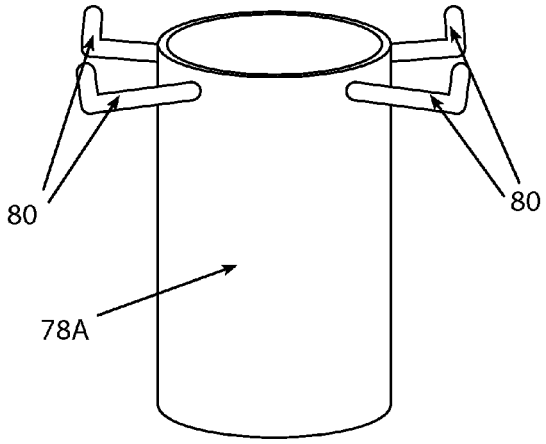
FIG. 8A contains a face view of the release member of the embodiment of FIG. 7.
Figure 8B:
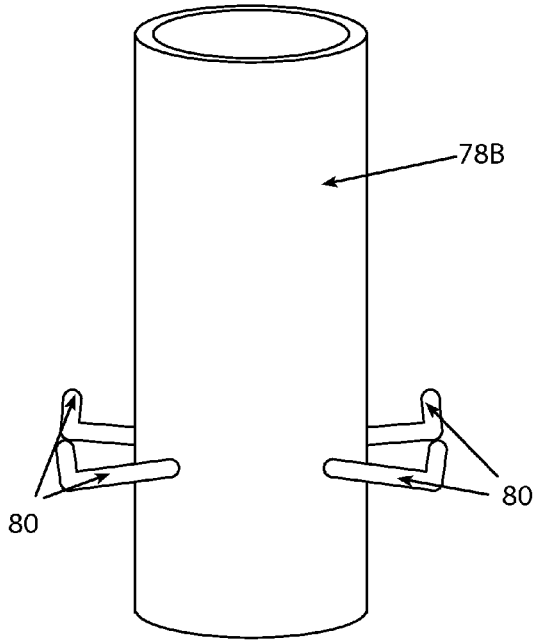
FIG. 8B contains an alternate embodiment of the member of FIG. of 8A.
Figure 8C:
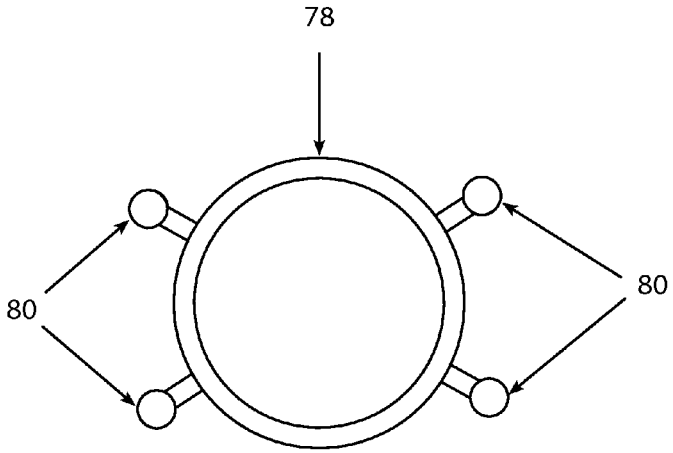
FIG. 8C contains a top view of a release member.
Figure 9:
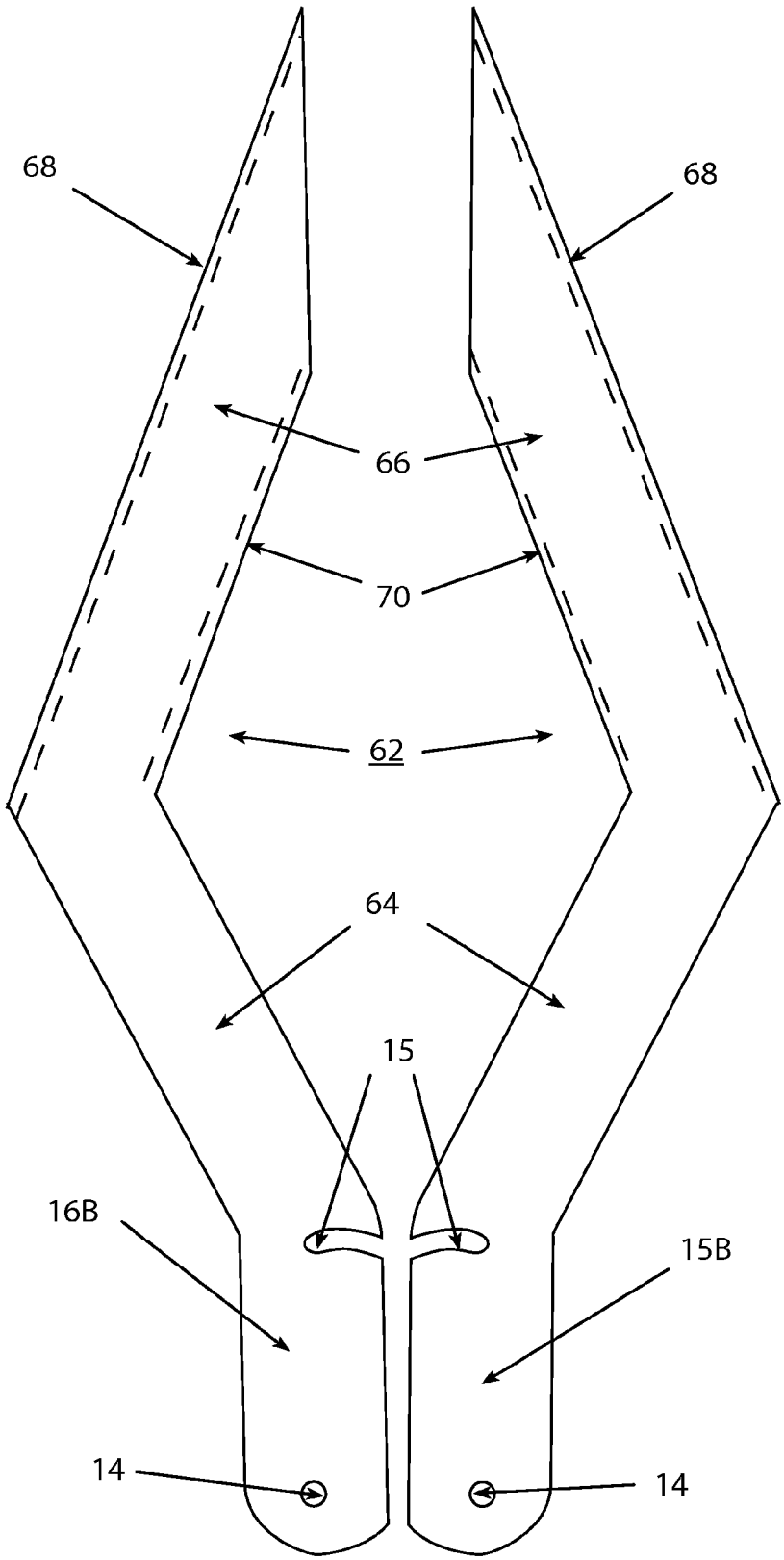
FIG. 9 contains a side view of a pair of blades of an alternate embodiment of the present invention.
Figure 10:
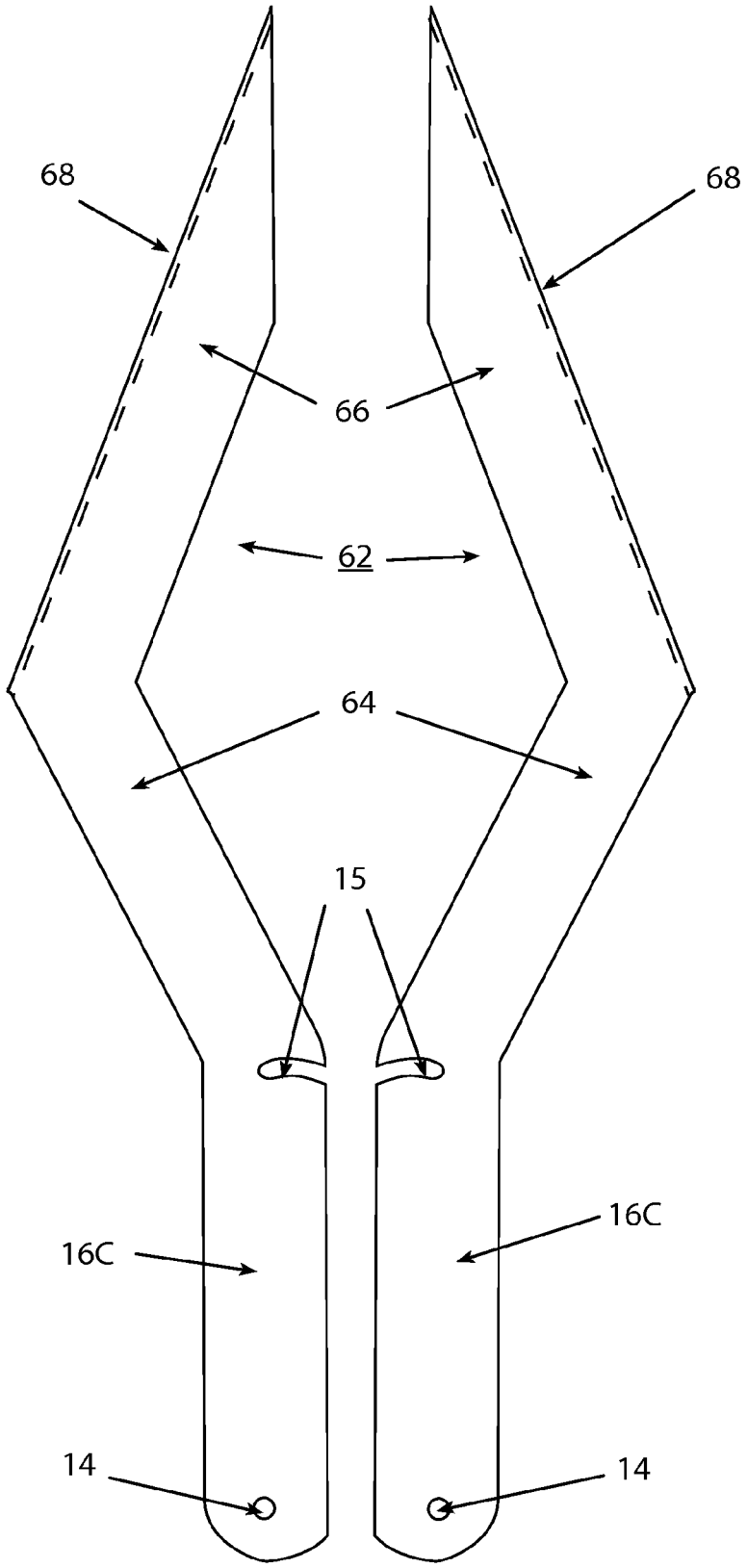
FIG. 10 contains a side view of a pair of blades of an alternate embodiment of the present invention.

In an embodiment the latch mechanism comprises a slide release (78) (78A) for holding the blades (62) in closed position in flight with a series of catches (80) for catching on the hide of the animal. As shown in FIGS. 8A-8C, the relative length of the slide release (78) (78A) (78B) with the relative position of catches can be used by those skilled in the art to determine the depth of penetration of the broad-head before opening of the blades (62) and delivery of the payload (74). Additionally as shown in FIGS. 9 and 10, the relative lengths of the elongate members (16B) vs. (16C) can influence the internal cutting diameter of the broad-head. Therefore a system with a high degree of freedom of constraint can be accomplished by those skilled in the art using this system.

Additionally guide races (15) can be incorporated to slide along a permanent pin (58) in order to accommodate the smooth opening of the blades (62).

CONCLUSION, RAMIFICATIONS, AND SCOPE

Although the present invention has been described in detail, those skilled in the art will understand that various changes, substitutions, and alterations herein may be made without departing from the spirit and scope of the invention in its broadest form. The invention is not considered limited to the example chosen for purposes of disclosure, and covers all changes and modifications which do not constitute departures from the true spirit and scope of this invention.

For example, although the foregoing refers to a payload delivery device being substantially a parallelogram, however, other shapes being teardrop, polygonal, spherical, elliptical and the like can also be used. Further it is contemplated that the payload need not be of uniform thickness. Further, blade and release or trigger details may vary from application to application in terms of dimensions and exact position of structural members, depending on the physical arrangement of the arrow, firing system, as well as the type of game being hunted.

We claim:

1. A payload delivery apparatus comprising;

(i) a combination arrow tip assembly and a payload, the tip assembly having a release mechanism;

(ii) wherein the payload is at least partially disposed within and held by the tip assembly and (iii) is released from the tip assembly subcutaneously in a target animal (iv) wherein the arrow tip further comprises a plurality of blades which separate to an open position after the arrow tip enters the target animal to release the payload at a predetermined depth.

2. The payload delivery apparatus in accordance with claim 1 wherein the payload comprises a device which carries at least one of; a transmitter, a gas cartridge, a gps device, a stun capacitor, a noise maker, a blood thinner, a string attachment, a dye.

3. The payload delivery apparatus in accordance with claim 2 wherein the device further comprises a keyway.

4. The payload delivery apparatus in accordance with claim 3 wherein the device is integrated with the arrow tip assembly such that the keyway strengthens the plurality of blades during penetration of the animal hide.

5. The payload delivery apparatus in accordance with claim 4 wherein the keyway acts as a track for the respective blades to slide along to further force the blades to separate.

6. The payload delivery apparatus in accordance with claim 5 wherein the keyway disengages at a predetermined point leaving the payload free to deposit to one side or the other within the animal.

7. The payload delivery apparatus in accordance with claim 5 wherein the depth of release of the payload is independent of the open position diameter.

8. The payload delivery apparatus in accordance with claim 7 wherein the plurality of blades further comprises dual cutting surfaces.

9. The payload delivery apparatus in accordance with claim 8 wherein the dual cutting surfaces comprise a surface designed to cut hide and bone, and another surface for cutting internal organs.

10. A method for delivering a payload into the body of an animal comprising:

(i) providing a combination arrow tip assembly comprising a plurality of blades and a payload;

(ii) providing a release mechanism associated with the tip assembly device;

(iii) setting the blades in a closed position about the payload;

(iv) directing the combination arrow tip assembly toward the target animal in such a way that the release mechanism causes blades to open releasing the payload subcutaneously into the target animal.

11. The method for delivering a payload into the body of an animal in accordance with claim 10 wherein the release mechanism is a predetermined distance behind the arrow tip assembly.

12. The method for delivering a payload into the body of an animal in accordance with claim 11 wherein the payload further comprises a device which carries at least one of; a transmitter, a gas cartridge, a gps device, a stun capacitor, a noise maker, a blood thinner, a string attachment, a dye.

13. The method for delivering a payload into the body of an animal in accordance with claim 11 wherein the device further comprises a keyway.

14. The method for delivering a payload into the body of an animal in accordance with claim 11 wherein the device is integrated with the arrow tip assembly such that the keyway strengthens the plurality of blades during penetration of an animal hide.

15. The method for delivering a payload into the body of an animal in accordance with claim 11 wherein the keyway acts as a track for the respective blades to slide along to further force the blades to separate.

16. The method for delivering a payload into the body of an animal in accordance with claim 11 wherein the blades continue to cut in the open position with a wider diameter than when in the closed position.

17. The method for delivering a payload into the body of an animal in accordance with claim 16 wherein the depth of release of the payload is controlled independently from the diameter of cut in the open position.

18. A payload delivery apparatus comprising a combination arrow tip assembly comprising:

(i) a plurality of blades which have the ability to pivot from a closed position to an open position, (ii) a payload comprising a transmitter, (iii) the tip assembly having a release mechanism;

(iv) wherein the payload is held by the tip assembly in a closed position and released from the tip assembly as the release mechanism reaches the hide of a target animal, causing the blades to separate to an open position at a predetermined position in the target animal (v) whereby the payload is released.

19. The apparatus in accordance with claim 18 wherein the predetermined position is variable with relationship to an open diameter.

* * * * *